US005151301A

United States Patent [19]

Kruger et al.

[11] Patent Number: 5,151,301

[45] Date of Patent: Sep. 29, 1992

[54] METHOD AND APPARATUS FOR APPLYING A SUBSTANCE TO AN ARTICLE

[75] Inventors: Leon J. Kruger; John A. Oatley, both of Cape Province, South Africa

[73] Assignee: McNeil-PPC, Inc., Milltown, N.J.

[21] Appl. No.: 734,388

[22] Filed: Jul. 23, 1991

[30] Foreign Application Priority Data

Jul. 26, 1990 [ZA] South Africa ..... 90/5894

[51] Int. Cl.[5] ..... B05D 7/00

[52] U.S. Cl. ..... 427/294; 118/308; 427/180; 427/296

[58] Field of Search ..... 427/180, 294, 296; 118/308, 506

[56] References Cited

FOREIGN PATENT DOCUMENTS 686283 5/1964 Canada ..... 118/308

*Primary Examiner*—Shrive Beck
*Assistant Examiner*—Terry J. Owens

[57] ABSTRACT

Apparatus 200 for applying particulate flowable superabsorbent or anti-odourant substance to an article comprises a metering component 202 rotatable about an axis. A plurality of circumferentially spaced metering chambers are provided in this component. The apparatus includes a feed device 18 for depositing the flowable substance successively in the chambers in a loading zone as the chambers move through the loading zone on rotation of the metering component so that each chamber contains a fixed quantity of the substance as it passes from the loading zone. The apparatus also includes a vacuum extraction device 50 for extracting the quantities of the substance successively from the chambers in a discharge zone spaced from the loading zone and an application device for applying the extracted quantities of substance to an article.

22 Claims, 4 Drawing Sheets

METHOD AND APPARATUS FOR APPLYING A SUBSTANCE TO AN ARTICLE

THIS INVENTION relates to a method of applying a substance to an article. It relates also to an apparatus for applying a substance to an article.

According to a first aspect of the invention, there is provided a method of applying a substance to an article, which method comprises rotating a plurality of circumferentially spaced metering chambers about an axis so that the chambers pass successively through a loading zone;

depositing a flowable substance in the chambers as they move through the loading zone so that each chamber contains a fixed quantity of the substance as it passes from the loading zone;

extracting the quantities of substance successively from the chambers in a discharge zone spaced from the loading zone, by means of negative pressure or suction; and applying the extracted quantities of substance to an article.

The depositing of the substance in the chambers may include allowing the substance to flow under gravity from a bulk container through a feed conduit terminating in the loading zone.

In one embodiment of the invention, the metering chambers may be provided in a horizontal disc rotating about a vertical axis. The method may then include removing, e.g. scraping, excess substance or material protruding from the chambers above the disc surface in the loading zone, thereby to provide the fixed or predetermined quantities of substance in the chambers.

In one version of the invention, the chambers may extend through the disc, with the extraction of the fixed or metered quantities of substance being effected from below the disc. However, in another version of the invention, the chambers may be in the form of indentations or recesses in the disc with the extraction of the fixed or metered quantities of substance being effected from above the disc.

In another embodiment of the invention, the metering chambers may be provided in the outer surface of a cylindrical member rotating about a horizontal axis. The method may then include removing excess substance protruding from the chambers above the cylinder surface in the loading zone. The substance extraction may then be effected in an upward direction.

The extraction may be effected by sucking the quantities of substance from the chambers along a transfer conduit, and conveying the substance pneumatically along the transfer conduit. The transfer conduit outlet may discharge the substance onto the article. The method may include simultaneously effecting a negative airflow through the article, so that the substance is sucked onto the article.

In particular, the flowable substance may be in particulate, e.g. powdered or granular, form. The method may be used particularly but not necessarily exclusively, in applying a particulate, e.g. powdered, superabsorbent substance, i.e. an inorganic or organic hydrogel substance capable of absorbing fluids, such as silica gels and cross-linked polymers, e.g. polyvinyl alcohol, carboxymethyl cellulose, and the like; or an anti-odourant agent, such as sodium bicarbonate, to an absorbent batt, to form a component for a sanitary towel, napkin, disposable diaper, or the like.

According to a second aspect of the invention, there is provided apparatus for applying a substance to an article, which apparatus comprises a metering component rotatable about an axis and having a plurality of circumferentially spaced metering chambers therein;

feed means for depositing a flowable substance successively in the chambers in a loading zone as the chambers move through the loading zone on rotation of the metering component so that each chamber contains a fixed quantity of the substance as it passes from the loading zone;

vacuum extraction means for extracting the quantities of the substance successively from the chambers in a discharge zone spaced from the loading zone; and application means for applying the extracted quantities of substance to an article.

The feed means may comprise a bulk vessel for the substance, and a feed conduit leading from the vessel, with the feed conduit having a discharge opening in the loading zone. The vessel and feed conduit may be arranged such that the substance flows under gravity from the vessel through the feed conduit.

The vacuum extraction means may comprise a transfer conduit having an inlet opening in the discharge zone, and vacuum generating means for generating a vacuum or negative pressure at the inlet opening end of the transfer conduit. The vacuum generating means may be a venturi mounted at or in proximity to the inlet opening end of the transfer conduit.

The other outlet end of the transfer conduit may constitute at least part of the application means, with the transfer conduit outlet end being located in an application zone through which the article passes, in use.

As mentioned hereinbefore, the substance may be a particulate anti-odourant substance such as sodium bicarbonate, with the article being a batt or layer of absorbent material, e.g. a batt or layer of ground pulp or the like, with the resultant batt or layer to which the sodium bicarbonate particles have been applied being suitable for use in forming personal hygiene or sanitary towels, napkins, diapers, or the like.

In one embodiment of the invention, the metering component may comprise a horizontal disc rotatable about a vertical axis. In one version of the invention, each chamber may then comprise an opening extending through the disc, with the metering component also comprising a closure member located below the disc and in sliding contact with the undersurface of the disc in the loading zone, but not in the discharge zone, so that the quantities of substance can be discharged from the underside of the disc in the discharge zone, and with the transfer conduit inlet opening end being located below the disc.

In another version of the invention, each chamber may comprise a recess or indentation in the disc, with the transfer conduit inlet opening end being located above the disc.

The chambers may be spaced equidistantly from the centre of the disc so that they constitute a first set of chambers, with at least one further set of circumferentially spaced chambers, spaced a different distance from the disc centre, also being provided, with the feed means being adapted, e.g. by having a plurality of feed conduits, to deposit the substance into at least one chamber of each set simultaneously and with the extraction means being adapted, e.g. by having a plurality of transfer conduits, to extract the quantities of substance from at least one chamber of each set simultaneously.

In another embodiment of the invention, the metering component may comprise a horizontal cylinder, rotatable about a horizontally extending axis, with the transfer conduit inlet opening end being located adjacent the cylinder surface at a position above the horizontal plane in which the axis lies.

At least one further set of circumferentially spaced chambers, spaced longitudinally from the other or first set of chambers, may then be provided. The feed means will then be adapted to deposit the substance simultaneously into at least one chamber of each set, and the extraction means adapted to extract the quantities of substance simultaneously from at least one chamber of each set, as hereinbefore described.

The chambers may be shaped to give a desired deposition pattern of the substance on the article. For example, to obtain deposition of the substance in a central or similar zone of the article, the openings or recesses may be circular. However, to obtain other deposition patterns, other chamber shapes may be more suitable. For example, to have the substance deposited along the length of the article, the openings or recesses may be elongated and shingled in respect of one another so that at any given instant, one opening or recess or portions of adjacent openings or recesses are in register with the inlet opening of the transfer conduit so that a continuous stream of metered substance is deposited on the article.

The apparatus may also include scraping means for scraping excess substance protruding from the chambers as they pass from the loading zone. The scraping means may then include the lower peripheral edge of the feed conduit discharge opening located immediately above the disc or cylinder surface.

The apparatus may also include further scraping means for scraping any excess substance present on the disc upper surface into the chambers as the chambers approach the loading zone. The further scraping means may include a scraper plate immediately above, i.e. in sliding contact with, the disc upper surface.

The invention will now be described by way of example with reference to the accompanying diagrammatic drawings.

Figure 1:
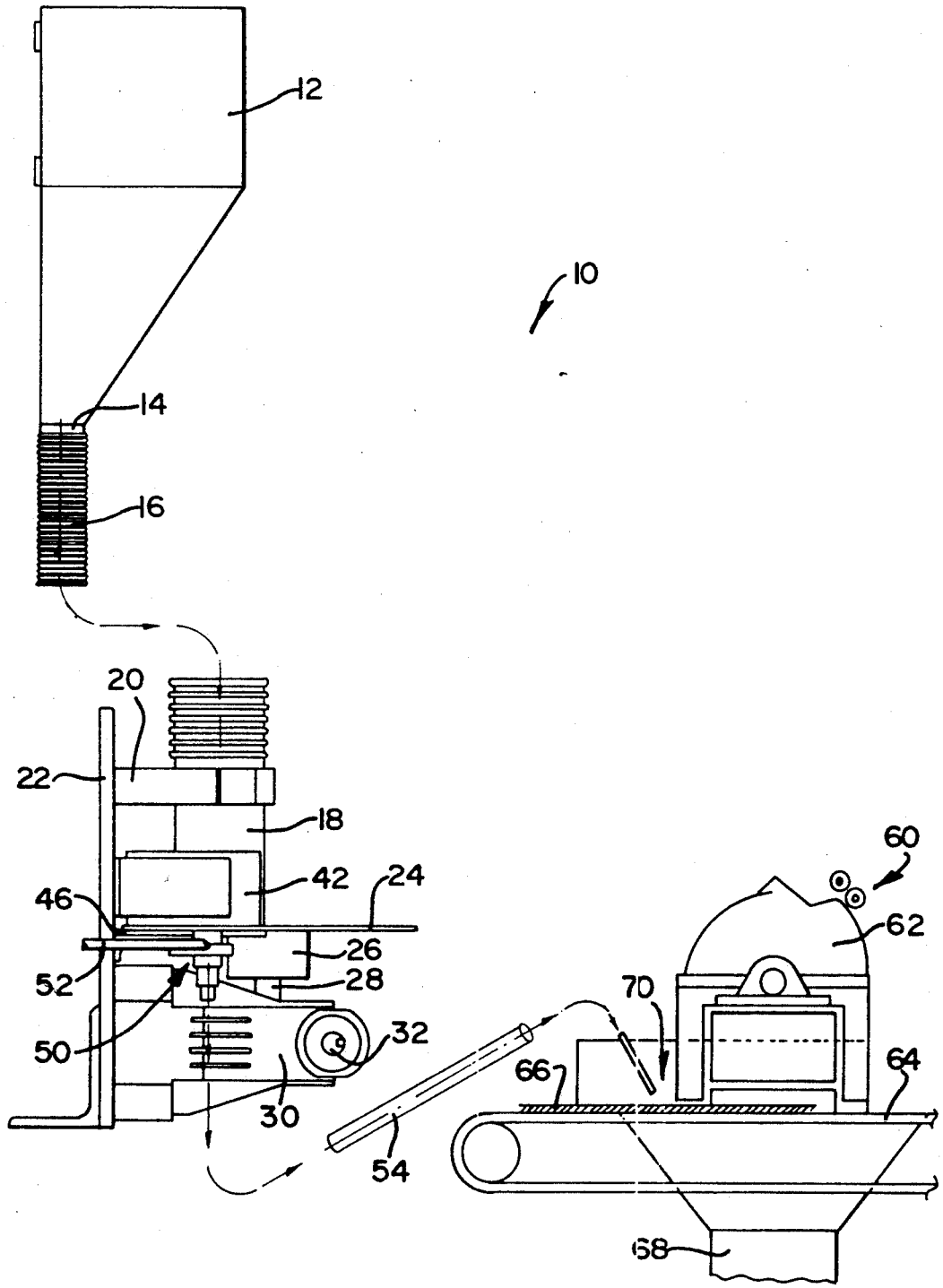
FIG. 1 shows a side view of apparatus for applying particulate sodium bicarbonate to an absorbent batt or layer, according to one embodiment of the invention.
Figure 2:
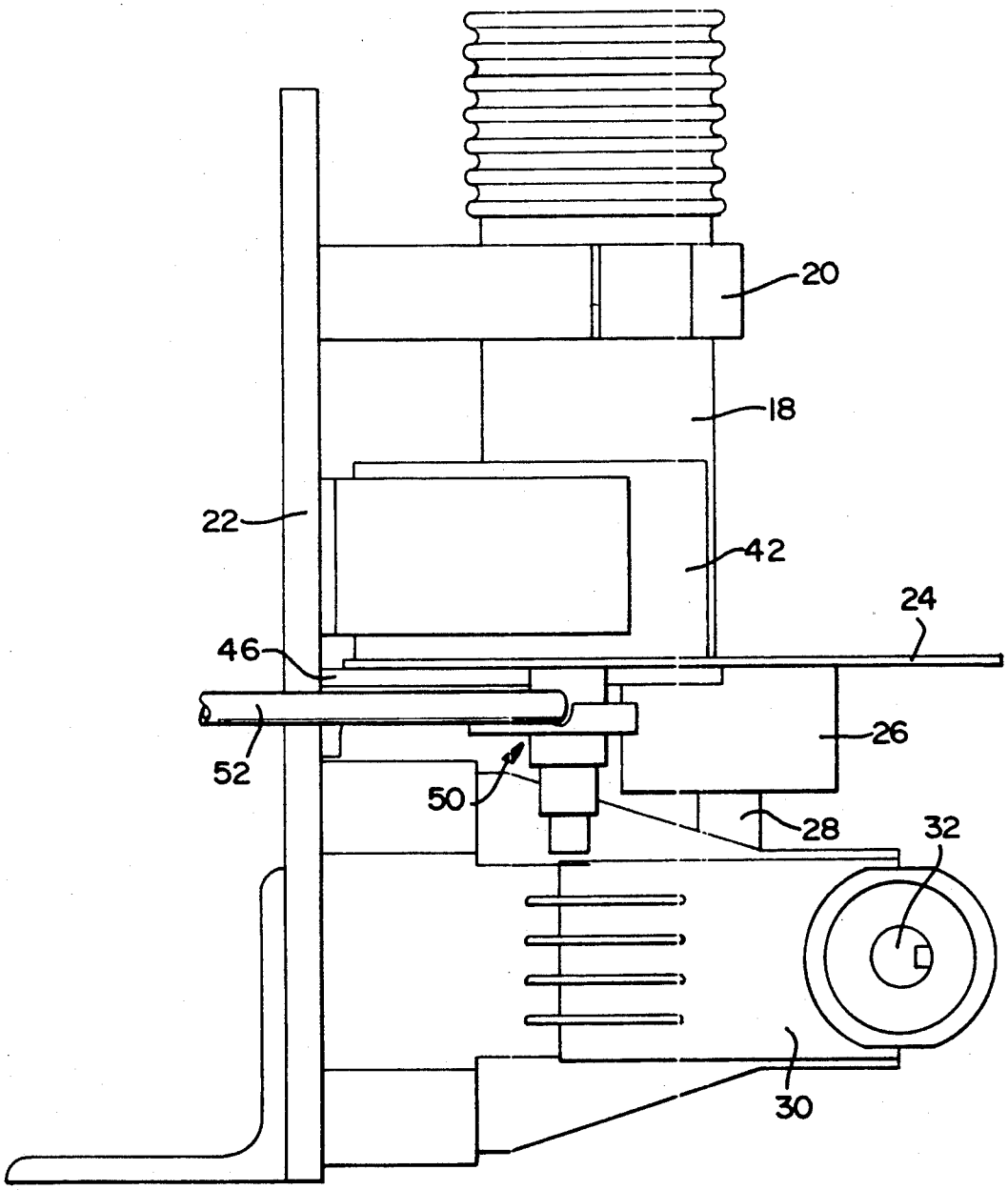
FIG. 2 shows an enlarged side view of part of the apparatus of FIG. 1.
Figure 3:
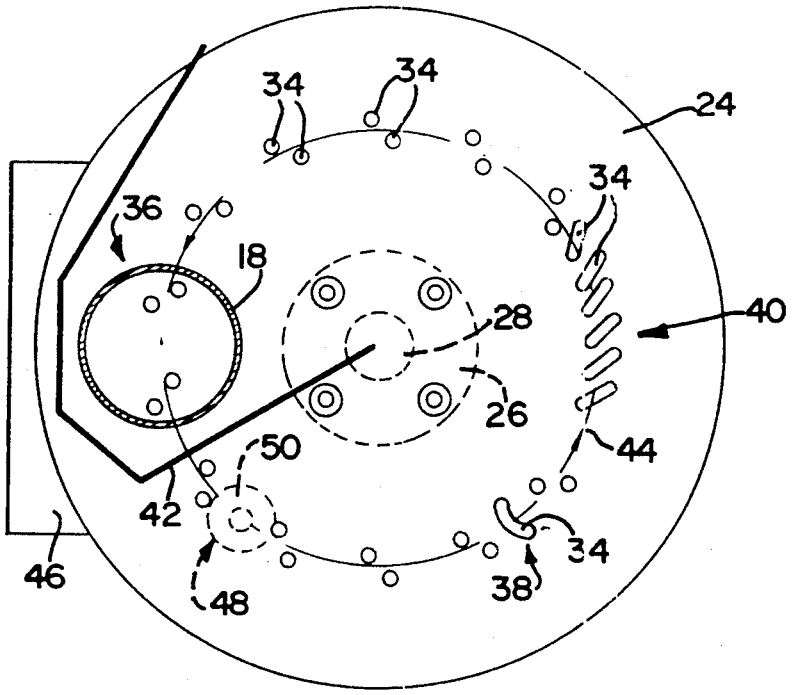
FIG. 3 shows a plan view of part of the apparatus of FIG. 1.

Referring to FIGS. 1 to 3, reference numeral 10 generally indicates apparatus for applying flowable particulate anti-odourant agent to an absorbent batt or layer, according to one embodiment of the invention.

The apparatus 10 includes a bulk vessel or hopper 12 for containing the particulate flowable anti-odourant agent such as sodium bicarbonate. The hopper 12 has a discharge nozzle 14 to which is fitted a flexible tube 16 defining a feed conduit.

The other end of the feed conduit 16 is attached to a feed tube 18 mounted, by means of a bracket/clamp 20, to a mounting plate 22. The anti-odourant agent can hence flow under gravity through the tubes 16, 18.

The lower end of the feed tube 18 terminates immediately above a rotatable metering disc 24, in a loading zone 36. The disc 24 is mounted to a boss 26, which is mounted to a vertical output shaft 28 of a right angle gearbox 30 having an input shaft 32. The input shaft 32 is operatively connected to apparatus 60, which is discussed in more detail hereunder, or to a suitable drive means (not shown) such as an electric motor. The disc 24 extends horizontally, and rotates about a vertically extending axis provided by the output shaft 28.

Through the disc 24 extends a plurality of openings 34, each opening defining a metering chamber. The openings 34 can be arranged in pairs, as indicated in FIG. 3, with the pairs of openings being spaced circumferentially apart or can be arranged singly as indicated at 38. The openings 34 are circular. However, in other embodiments of the invention, they can be any other desired shape, as indicated at 38 and 40 in FIG. 3, and which are described in more detail hereunder.

A scraper plate 42 is mounted adjacent the tube 18, and is in sliding contact with the upper surface of the disc 24. Hence, in use, as the disc 24 rotates in the direction indicated by reference numeral 44 in FIG. 3, anti-odourant agent flowing from the hopper 12 into the feed tube 18, will fill the openings 34 immediately below the feed tube 18. A base plate 46 located below the disc 24 and in sliding contact with the undersurface thereof, prevents the anti-odourant agent from passing through the openings 34 in the zone 36. As the disc 24 rotates, excess material protruding above the openings 34 is scraped off the disc upper surface by means of the scraper plate 42. In this fashion, equal quantities of anti-odourant agent are loaded into each of the openings 34.

Immediately below the disc 24, in a discharge zone 48, is mounted a venturi 50. The venturi 50 has an inlet opening aligned with the openings 34 and hence, in use, suction is generated in the zone 48 with this suction extracting the metered doses of anti-odourant agent from the chambers. An air tube 52 for feeding microfiltered compressed air into the venturi as suction generating medium, is also provided, while a transfer tube 54, providing a pneumatic anti-odourant agent transfer conduit, is connected to the other end of the venturi. Part of the tube 54 can be transparent, if desired, to monitor the 'slugs' of anti-odourant agent moving along it.

The tube 54 leads from the venturi 50 to an apparatus, generally indicated by reference numeral 60. The apparatus 60 is more-or-less conventional and is capable of forming a batt or layer of absorbent ground pulp particles, and includes a hammermill 62 in which large pulp particles are comminuted, and continuous vacuum forming belt 64 on which the comminuted pulp particles or fluff are deposited as the batt or layer 66. The belt 64 is of mesh form, and the batt 66 is formed thereon by means of suction created by a vacuum fan 68. The tube 54 terminates in a application zone 70 in which the sodium bicarbonate is deposited on the batt 66.

In use, anti-odourant agent is transported along the tube 54 as hereinbefore described, in the form of separate 'slugs' passing along the tube 54. The tube 54 should be as short as possible, and preferably less than 2 m, e.g. the apparatus 10 can be located immediately above the batt 66 so that the slugs do not dissipate as a result of the friction in the tube, and to minimize erosion of the tube. These slugs of anti-odourant agent are then deposited at predetermined intervals on the batt 66. The zone 70 in which the outlet of the tube 54 is located, is hence in an area which has a negative airflow through the layer 66 to which the anti-odourant agent is applied. This ensures that the anti-odourant agent is sucked down onto the product and not blown about by the transport air. Thereafter, the absorbent batt 66 will be cut into a desired shape to form components of sanitary towels, napkins, disposable diapers, or the like, in which the anti-odourant agent is located in a desired zone or position on each of the pads, e.g. at its centre.

The volume of the openings 34, i.e. their diameter and the thickness of the disc, naturally determines the amount of anti-odourant agent deposited onto each sanitary device, with each group of openings 34 representing one dose of anti-odourant agent per sanitary device. The shape of the openings and the relative arrangement of the openings 34, determine the size and shape of the zone in which the anti-odourant agent is deposited on the article. For example, with the circular openings 34, arranged as indicated in FIG. 3, it will be possible to deposit anti-odourant agent in a central zone in each sanitary towel. Typically, the openings 34 are located in a circle having a diameter of 160 mm, with the openings 34 each having a diameter of 6 mm, and 14 pairs of the openings being provided.

However, if it is desired to deposit the anti-odourant agent in a continuous line along the towel, then openings 34 similar to those indicated at reference numeral 40 in FIG. 3, can be used. These openings 34 are in the form of elongate slots arranged in such a fashion, that the one end of one slot overlaps the other end of an adjacent slot. Hence, when the slots 34 pass over the venturi 50, the venturi will continually be in register with at least a portion of one of the slots, so that the predetermined amounts of anti-odourant agent are transferred continually along the tube 54. To obtain very short pulses, so that the anti-odourant agent is deposited in a relatively small zone of the pad, a kidney shaped opening such as opening 34 indicated at reference numeral 38 in FIG. 3, can be used. By varying the configuration of the openings 34, on the disc, the length of the dose is thus variable from short intermittent pulses to a continuous line. By changing the timing of the disc in relation to the movement of the layer along the belt 64, the position of the anti-odourant agent zones on the batt or layer 66 can thus be adjusted.

Figure 4:
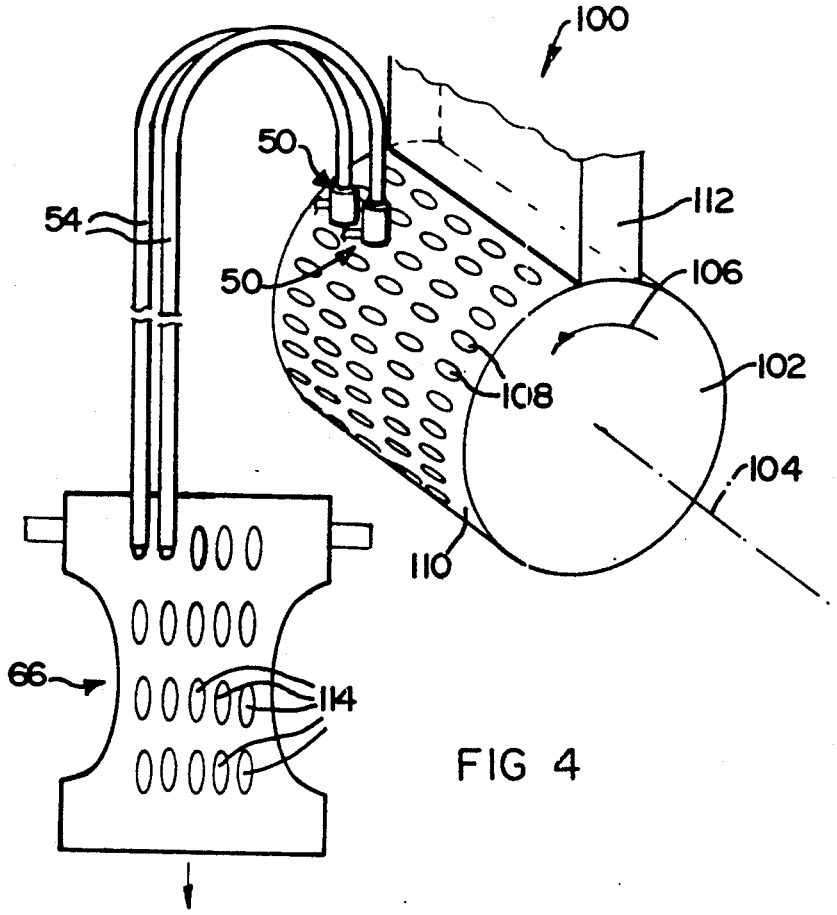
FIG. 4 shows a three-dimensional view of apparatus for applying particulate super-absorbant substance to an absorbent batt, according to another embodiment of the invention.

Referring to FIG. 4, reference numeral 100 generally indicates apparatus for applying particulate flowable super-absorbant substance to an absorbent wad 66, according to another embodiment of the invention.

Components of the apparatus 100 which are the same or similar to those of the apparatus 10, are indicated with the same reference numerals.

Instead of having the metering disc 24, the apparatus 100 has rotatable cylindrical metering drum 102. The drum 102 is mounted to rotate about a horizontal axis 104, in the direction of arrow 106, and is driven to rotate by suitable drive means (not shown).

A plurality of oval recesses 108 are provided in the cylindrical surface 110 of the drum, with each recess providing a metering chamber. The recesses 108 are arranged in rows extending across the drum, with the rows being spaced circumferentially about the drum.

Instead of the feed tube 18, a feed chute 112, leading from the bulk hopper, is provided. A scraper plate (not shown), similar to the scraper plate 42, may also be provided.

A venturi 50 and transfer tube 54 is provided for each recess in a row of recesses extending across the drum, with the venturis being located above a horizontal plane in which the axis 104 is located.

The apparatus 100 functions substantially similarly to the apparatus 10, save that, as a result of the plurality of recesses in each row, the super-absorbent substance can be deposited in discrete zones 114 spaced laterally across and longitudinally along the wad 66, which can be a diaper pulp panel, preformed by means of vacuum forming or by shaping a batt or layer.

Figure 5:
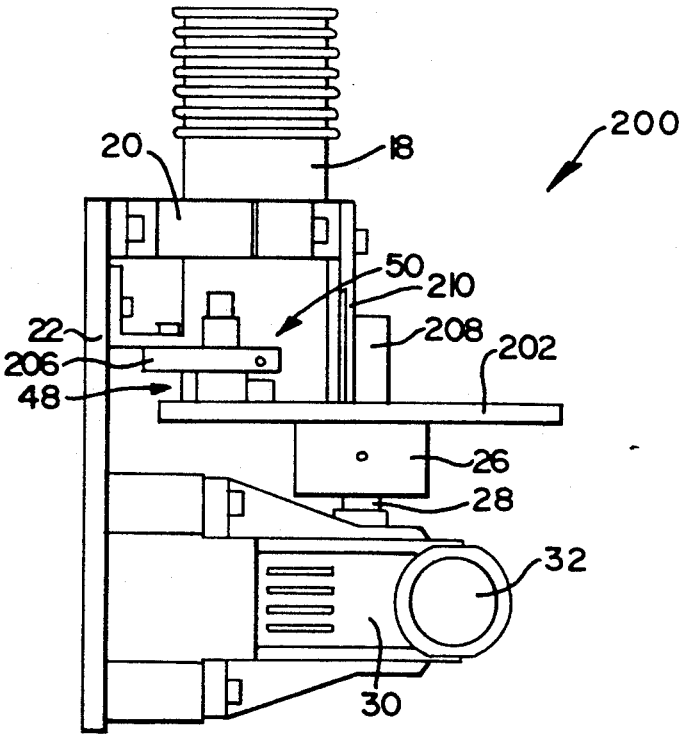
FIG. 5 shows a side view, similar to FIG. 2, of part of apparatus for applying particular particulate super-absorbent or anti-odourant substance to an absorbent batt or layer, according to yet another embodiment of the invention.
Figure 6:
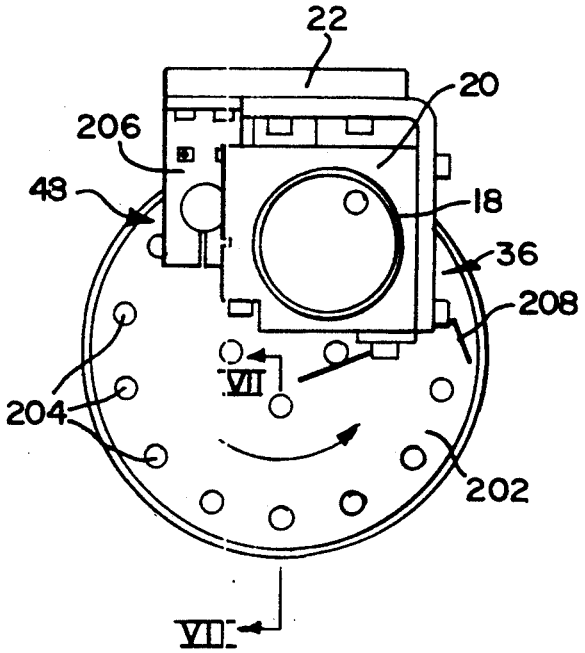
FIG. 6 shows a plan view of the apparatus of FIG. 5.
Figure 7:
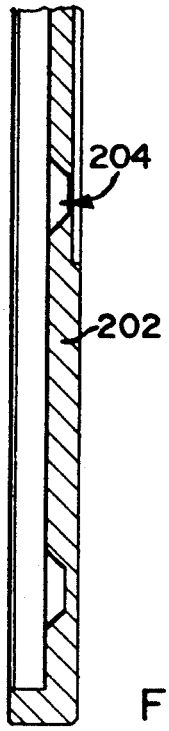
FIG. 7 shows a sectional view through VII—VII in FIG. 6.

Referring to FIGS. 5 to 7, reference numeral 200 generally indicates apparatus for applying particulate flowable super-absorbent or anti-odourant substance to an absorbent batt, according to yet another embodiment of the invention.

Components of the apparatus 200 which are the same or similar to those of the apparatus 10, are indicated with the same reference numerals.

The apparatus 200 includes a rotatable metering disc 202. The disc 202 is similar to the disc 24 save that, instead of having openings 34 extending through it, it has a plurality of circumferentially spaced recesses or indentations 204 therein. Furthermore, in the apparatus 200, the venturi 50 is located above the disc so that the discharge zone 48 is located above the disc. The venturi 50 of the apparatus 200 is held in position by means of a venturi clamp 206.

In the apparatus 200, the lower peripheral edge of the feed tube 18 which is located immediately above, i.e. with sliding clearance from, the disc 202, constitutes scraping means for scraping excess material from the recesses 204 as the filled recesses move from the loading zone. However, the apparatus 200 also includes an angled scraper plate 208, mounted in position by means of a scraper support 210 connected to the bracket/clamp 20, ahead of the loading zone. As the disc 202 rotates, the scraper plate 208 scrapes any excess particulate substance present on the upper disc surface into the recesses or cavities 204 before they enter the loading zone. This reduces wastage, and also reduces contamination of the moving parts.

The apparatus 200 functions in similar fashion to the apparatus 10, save that the extraction of the particulate substance from the recesses 204 is effected in an upward direction by the venturi 50.

In the apparatus 10, 200 a plurality of loading and discharge zones, each comprising its own feed tube 18 and venturi 50 may be provided. In this manner large quantities of the particulate substance can be applied or quicker pulsing for high speed manufacture can be provided.

The Applicant believes that with apparatus 10, 100, 200 super-absorbent or anti-odourant agent can be applied consistently and efficiently in accurate amounts, and in an accurately demarcated zones, on an absorbent batt, wad or layer, which can be processed further to form sanitary towels, napkins, disposable diapers, or the like. The apparatus 10, 100, 200 also have the advantage of being relatively inexpensive to fabricate, and operate.

We claim:

1. A method of applying a substance to an article, which method comprises rotating a plurality of circumferentially spaced metering chambers about an axis so that the chambers pass successively through a loading zone;

depositing a flowable substance in the chambers as they move through the loading zone so that each chamber contains a fixed quantity of the substance as it passes from the loading zone;

extracting the quantities of substance successively from the chambers in a discharge zone spaced from the loading zone, by means of suction; and applying the extracted quantities of substance to an article.

2. A method according to claim 1, wherein the depositing of the substance in the chambers includes allowing the substance to flow under gravity from a bulk container through a feed conduit terminating in the loading zone.

3. A method according to claim 1, wherein the metering chambers are provided in a horizontal disc rotating about a vertical axis, with the method including removing excess substance protruding from the chambers above the disc surface in the loading zone, thereby providing the fixed quantities of substance in the chambers.

4. A method according to claim 3, wherein the chambers extend through the disc, with the extraction of the quantities of substance being effected from below the disc.

5. A method according to claim 3, wherein the chambers are in the form of indentations or recesses in the disc with the extraction of the quantities of substance being effected from above the disc.

6. A method according to claim 1, wherein the metering chambers are provided in the outer surface of a cylindrical member rotating about a horizontal axis, with the method including removing excess substance protruding from the chambers above the cylinder surface in the loading zone, and effecting the substance extraction in an upward direction.

7. A method according to claim 1, wherein the extraction is effected by sucking the quantities of substance from the chambers into a transfer conduit, and conveying the substance pneumatically along the transfer conduit to a transfer conduit outlet.

8. A method according to claim 7, wherein the transfer conduit outlet discharges the substance onto the article, with the method including simultaneously effecting a negative airflow through the article, so that the substance is sucked onto the article.

9. A method according to claim 1, wherein the flowable substance is a particulate super-absorbent substance, or an anti-odourant substance, with the article to which it is supplied being an absorbent batt.

10. Apparatus for applying a substance to an article, which apparatus comprises a metering component rotatable about an axis and having a plurality of circumferentially spaced metering chambers therein;

feed means for depositing a flowable substance successively into the chambers in a loading zone as the chambers move through the loading zone on rotation of the metering component so that each chamber contains a fixed quantity of the substance as it passes from the loading zone;

vacuum extraction means for extracting the quantities of the substance successively from the chambers in a discharge zone spaced from the loading zone; and application means for applying the extracted quantities of substance to an article.

11. Apparatus according to claim 10, wherein the feed means comprises a bulk vessel for the substance, and a feed conduit leading from the vessel, with the feed conduit having a discharge opening in the loading zone, with the vessel and feed conduit being arranged such that the substance flows under gravity from the vessel through the feed conduit.

12. Apparatus according to claim 10, wherein the vacuum extraction means comprises a transfer conduit having an inlet opening in the discharge zone, and vacuum generating means for generating a suction at the inlet opening end of the transfer conduit.

13. Apparatus according to claim 12, wherein the vacuum generating means is a venturi mounted at or in proximity to the inlet opening end of the transfer conduit.

14. Apparatus according to claim 12, wherein the outlet end of the transfer conduit constitutes at least part of the application means, with the transfer conduit outlet end being located in an application zone through which the article passes, in use, and wherein the substance is a particulate anti-odurant substance and the article is a batt or layer of absorbent material.

15. Apparatus according to claim 12, wherein the metering component comprises a horizontal disc rotatable about a vertical axis.

16. Apparatus according to claim 15, wherein each chamber comprises an opening extending through the disc, with the metering component also comprising a closure member located below the disc and in sliding contact with the undersurface of the disc in the loading zone, but not in the discharge zone, so that the quantities of substance can be discharged from the underside of the disc in the discharge zone, and with the transfer conduit inlet opening end being located below the disc.

17. Apparatus according to claim 15, wherein each chamber comprises a recess or indentation in the disc, with the transfer conduit inlet opening end being located above the disc.

18. Apparatus according to claim 15, wherein the chambers are spaced equidistantly from the centre of the disc and constitute a first set of chambers, with at least one further set of circumferentially spaced chambers, spaced a different distance from the disc centre, also being provided, with the feed means being adapted to deposit the substance into at least one chamber of each set simultaneously and with the extraction means being adapted to extract the quantities of substance from at least one chamber of each set simultaneously.

19. Apparatus according to claim 12, wherein the metering component comprises a horizontal cylinder, rotatable about a horizontally extending axis, with the transfer conduit inlet opening end being located adjacent the cylinder surface at a position above the horizontal plane in which the axis lies.

20. Apparatus according to claim 19, wherein at least one further set of circumferentially spaced chambers, spaced longitudinally from the other set of chambers, is provided, with the feed means being adapted to deposit the substance simultaneously into at least one chamber of each set, and the extraction means being adapted to extract the quantities of substance simultaneously from at least one chamber of each set.

21. Apparatus according to claim 12, wherein the chambers are circular.

22. Apparatus according to claim 12, wherein the chambers are elongate and shingled in respect of one another so that at any given instant, one chamber or portions of adjacent chambers are in register with the inlet opening of the transfer conduit so that a continuous stream of metered substance is deposited on the article.

* * * * *